US008281459B2

(12) United States Patent
Le et al.

(10) Patent No.: US 8,281,459 B2
(45) Date of Patent: Oct. 9, 2012

(54) INTEGRATED LOCKING HINGE

(75) Inventors: Leonard Le, Garden Grove, CA (US); Keith R. Burrell, Redondo Beach, CA (US); Thomas L. Kehl, El Segundo, CA (US); Epifanio P. Gonyea, San Pedro, CA (US)

(73) Assignee: Raytheon Company, Waltham, MA (US)

( * ) Notice: Subject to any disclaimer, the term of this patent is extended or adjusted under 35 U.S.C. 154(b) by 184 days.

(21) Appl. No.: 12/816,892

(22) Filed: Jun. 16, 2010

(65) Prior Publication Data

US 2011/0308041 A1 Dec. 22, 2011

(51) Int. Cl.
*E05D 11/06* (2006.01)

(52) U.S. Cl. ..... 16/374; 16/350; 16/352; 16/361

(58) Field of Classification Search ..... 16/331, 16/332, 350, 352, 348, 371, 374, 357–361, 16/342

See application file for complete search history.

(56) References Cited

U.S. PATENT DOCUMENTS

| | | | | | |
|---|---|---|---|---|---|
| 393,217 | A | * | 11/1888 | Cutter | 16/352 |
| 442,689 | A | * | 12/1890 | Porter | 16/350 |
| 447,971 | A | * | 3/1891 | Porter | 16/350 |
| 510,864 | A | * | 12/1893 | Johnson | 16/348 |
| 553,650 | A | * | 1/1896 | Kingsland | 403/353 |
| 1,106,569 | A | * | 8/1914 | Kessler | 108/179 |
| 1,335,999 | A | * | 4/1920 | Stover | 16/361 |
| 2,584,173 | A | * | 2/1952 | Van Fowler | 312/303 |
| 3,083,403 | A | * | 4/1963 | Van Noord | 16/361 |
| 4,131,378 | A | | 12/1978 | Daws | |
| 4,362,118 | A | * | 12/1982 | Koch et al. | 114/201 R |
| 4,609,234 | A | * | 9/1986 | Naniwa et al. | 312/296 |
| 5,044,044 | A | * | 9/1991 | Young et al. | 16/323 |
| 5,063,916 | A | | 11/1991 | France et al. | |
| 5,111,802 | A | * | 5/1992 | Lin | 126/25 R |
| 5,193,695 | A | | 3/1993 | Mann | |
| 5,267,780 | A | | 12/1993 | Friesen et al. | |
| 5,577,296 | A | | 11/1996 | Grass | |
| 6,004,283 | A | | 12/1999 | Young | |
| 6,470,532 | B2 | * | 10/2002 | Rude | 16/335 |
| D469,683 | S | | 2/2003 | Votruba et al. | |
| 6,539,584 | B1 | | 4/2003 | Gillotti | |
| 6,591,453 | B2 | | 7/2003 | Jenks | |
| 6,591,533 | B2 | | 7/2003 | Wygant | |
| 7,003,849 | B2 | | 2/2006 | Cohen et al. | |
| 7,051,404 | B2 | | 5/2006 | Roy | |
| 7,100,243 | B1 | | 9/2006 | Platzke | |
| 7,235,059 | B2 | | 6/2007 | Mason et al. | |
| D551,940 | S | | 10/2007 | Whinery | |
| D566,519 | S | | 4/2008 | Whinery | |
| 7,422,047 | B1 | | 9/2008 | McDonald | |
| 7,590,435 | B2 | | 9/2009 | Park et al. | |
| 7,640,870 | B2 | | 1/2010 | Strong et al. | |

* cited by examiner

*Primary Examiner* — Chuck Y. Mah
(74) *Attorney, Agent, or Firm* — Pierce Atwood LLP; Joseph M. Maraia

(57) ABSTRACT

A locking hinge that includes a first hinge element including a body defining a first hole and a second hinge element including a body defining a second hole. The locking hinge also includes a dowel assembled through the first hole in the first hinge element and the second hole in the second hinge element defining a hinge joint axis permitting translation of the second hinge element relative to the first hinge element along a first axis and a second axis, and rotation of the second hinge element relative to the first hinge element.

20 Claims, 5 Drawing Sheets

INTEGRATED LOCKING HINGE

FIELD OF THE INVENTION

The present invention relates to locking hinge systems and methods for operating locking hinges.

BACKGROUND

Prior art locking hinges tend to be complex and relatively large. One type of conventional hinge system used in electronics chassis employs a prop rod that is integrated into the system. One portion of the hinge is attached to the chassis and a second portion of the hinge is attached to a cover. The prop rod is capable of holding the cover open; however, the prop rod takes up valuable storage volume within the chassis.

A need therefore exists for improved locking hinge systems and methods for operating locking hinges.

SUMMARY

Embodiments described herein relate generally to locking hinge systems and methods for operating locking hinges.

One embodiment features a locking hinge that includes a first hinge element including a body defining a first hole. The embodiment also includes a second hinge element including a body defining a second hole. The embodiment also includes a dowel assembled through the first hole in the first hinge element and the second hole in the second hinge element defining a hinge joint axis permitting translation of the second hinge element relative to the first hinge element along a first axis and a second axis, and rotation of the second hinge element relative to the first hinge element.

In some embodiments, the second hole of the second hinge element is a slot having a first channel that intersects a second channel, wherein the first channel is aligned with the first axis and the second channel is aligned with the second axis. In some embodiments, the body of the second hinge element comprises a slot key and the body of first hinge element defines a slot capable of receiving the slot key. The slot key can be, for example, an angular positioning slot key.

In some embodiments, the slot key fits within the slot to limit movement of the second hinge element relative to the first hinge element. In some embodiments, the slot key includes an adjustment mechanism for adjusting orientation of the slot key on the second hinge element. In some embodiments, the orientation of the slot key on the second hinge element alters an angle between the first hinge element and the second hinge element about the hinge joint axis. In some embodiments, the locking hinge includes mounting features (e.g., mounting holes) in the body of the first hinge element and the body of the second hinge element. In some embodiments, the locking hinge includes a base coupled to the first hinge element and a lid coupled to the second hinge element. In some embodiments, the locking hinge includes a locking mechanism to limit movement of the second hinge element relative to the first hinge element.

Another embodiment features a method for operating a locking hinge that includes a first hinge element including a body defining a first hole, a second hinge element including a body defining a second hole, and a dowel assembled through the first hole in the first hinge element and the second hole in the second hinge element defining a hinge joint axis permitting translation of the second hinge element relative to the first hinge element along a first axis and a second axis, and rotation of the second hinge element relative to the first hinge element. The method includes the step of displacing the second hinge element relative to the first hinge element along a first direction of the first axis. The method also includes rotating the second hinge element relative to the first hinge element in a first direction about the hinge joint axis. The method also includes displacing the second hinge element relative to the first hinge element along a first direction of the second axis.

In some embodiments, the method includes displacing the second hinge element relative to the first hinge element along the first direction of the second axis until a slot key associated with the body of the second hinge element engages a slot associated with the body of the first hinge element. In some embodiments, the second hinge element is locked when the slot key engages the slot.

In some embodiments, the method includes adjusting an adjustment mechanism associated with the slot key to alter an angle between the first hinge element and the second hinge element about the hinge joint axis. In some embodiments, the method includes displacing the second hinge element relative to the first hinge element along a second direction of the second axis until the slot key associated with the body of the second hinge element disengages the slot associated with the body of the first hinge element.

In some embodiments, the method includes rotating the second hinge element relative to the first hinge element in a second direction about the hinge joint axis. In some embodiments, the method includes displacing the second hinge element relative to the first hinge element along a second direction of the first axis.

Another embodiment features a method for operating a locking hinge of a structure (e.g., box structure) that includes a base and a lid, wherein a first hinge element of the locking hinge is coupled to the base and a second hinge element of the locking hinge is coupled to the lid, and the first hinge element includes a body defining a first hole, the second hinge element includes a body defining a second hole, and the locking hinge includes a dowel assembled through the first hole in the first hinge element and the second hole in the second hinge element defining a hinge joint axis permitting translation of the second hinge element relative to the first hinge element along a first axis and a second axis, and rotation of the second hinge element relative to the first hinge element. The method includes the step of displacing the second hinge element relative to the first hinge element along a first direction of the first axis to open the box structure by displacing the lid from a surface of the base.

In some embodiments, the method includes rotating the second hinge element relative to the first hinge element in a first direction about the hinge joint axis. In some embodiments, the method includes displacing the second hinge element relative to the first hinge element along a first direction of the second axis until a slot key associated with the body of the second hinge element engages a slot associated with the body of the first hinge element. In some embodiments, the method includes displacing the second hinge element relative to the first hinge element along a second direction of the second axis until the slot key associated with the body of the second hinge element disengages the slot associated with the body of the first hinge element.

In some embodiments, the method includes rotating the second hinge element relative to the first hinge element in a second direction about the hinge joint axis. In some embodiments, the method includes displacing the second hinge element relative to the first hinge element along a second direction of the first axis to close the box structure by causing the lid to contact the surface of the base. In some embodiments, the method includes adjusting an adjustment mechanism associated with the slot key to alter angular position between the first hinge element and the second hinge element to a desired open position.

Another embodiment features a method for operating a locking hinge of an electronics box structure that includes a module mounting frame and a backplane, wherein a first hinge element of the locking hinge is coupled to the module mounting frame structure and a second hinge element of the locking hinge is coupled to a backplane, and the first hinge element includes a body defining a first hole, the second hinge element includes a body defining a second hole, and the locking hinge includes a dowel assembled through the first hole in the first hinge element and the second hole in the second hinge element defining a hinge joint axis permitting translation of the second hinge element relative to the first hinge element along a first axis and a second axis, and rotation of the second hinge element relative to the first hinge element. The method includes the step of displacing the second hinge element relative to the first hinge element along a first direction of the first axis to disengage the backplane by displacing the backplane from a surface of the module mounting frame.

In some embodiments, the method includes rotating the second hinge element relative to the first hinge element in a first direction about the hinge joint axis. In some embodiments, the method includes displacing the second hinge element relative to the first hinge element along a first direction of the second axis until a slot key associated with the body of the second hinge element engages a slot associated with the body of the first hinge element. In some embodiments, the method includes adjusting an adjustment mechanism associated with the slot key to alter angular position between the first hinge element and the second hinge element to a desired open position.

In some embodiments, the method includes displacing the second hinge element relative to the first hinge element along a second direction of the second axis until the slot key associated with the body of the second hinge element disengages the slot associated with the body of the first hinge element. In some embodiments, the method includes rotating the second hinge element relative to the first hinge element in a second direction about the hinge joint axis. In some embodiments, the method includes displacing the second hinge element relative to the first hinge element along a second direction of the first axis to close the electronics box structure by causing the backplane to contact the surface of the module mounting frame.

Other aspects and advantages of the present invention will become apparent from the following detailed description, taken in conjunction with the accompanying drawings, illustrating the principles of the invention by way of example only.

BRIEF DESCRIPTION OF THE DRAWINGS

The foregoing features of various embodiments of the invention will be more readily understood by reference to the following detailed description, taken with reference to the accompanying drawings, in which.

DETAILED DESCRIPTION OF ILLUSTRATIVE EMBODIMENTS

Figure 1B:
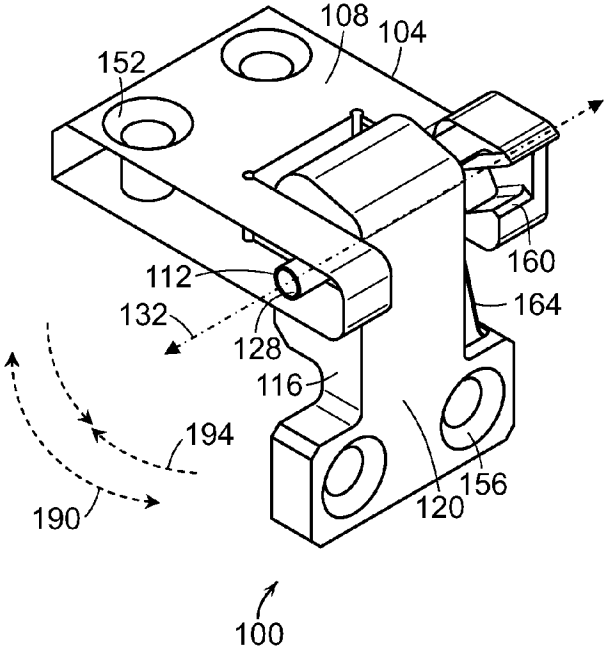
FIG. 1B is an assembled view of the locking hinge of FIG. 1A.
Figure 1A:
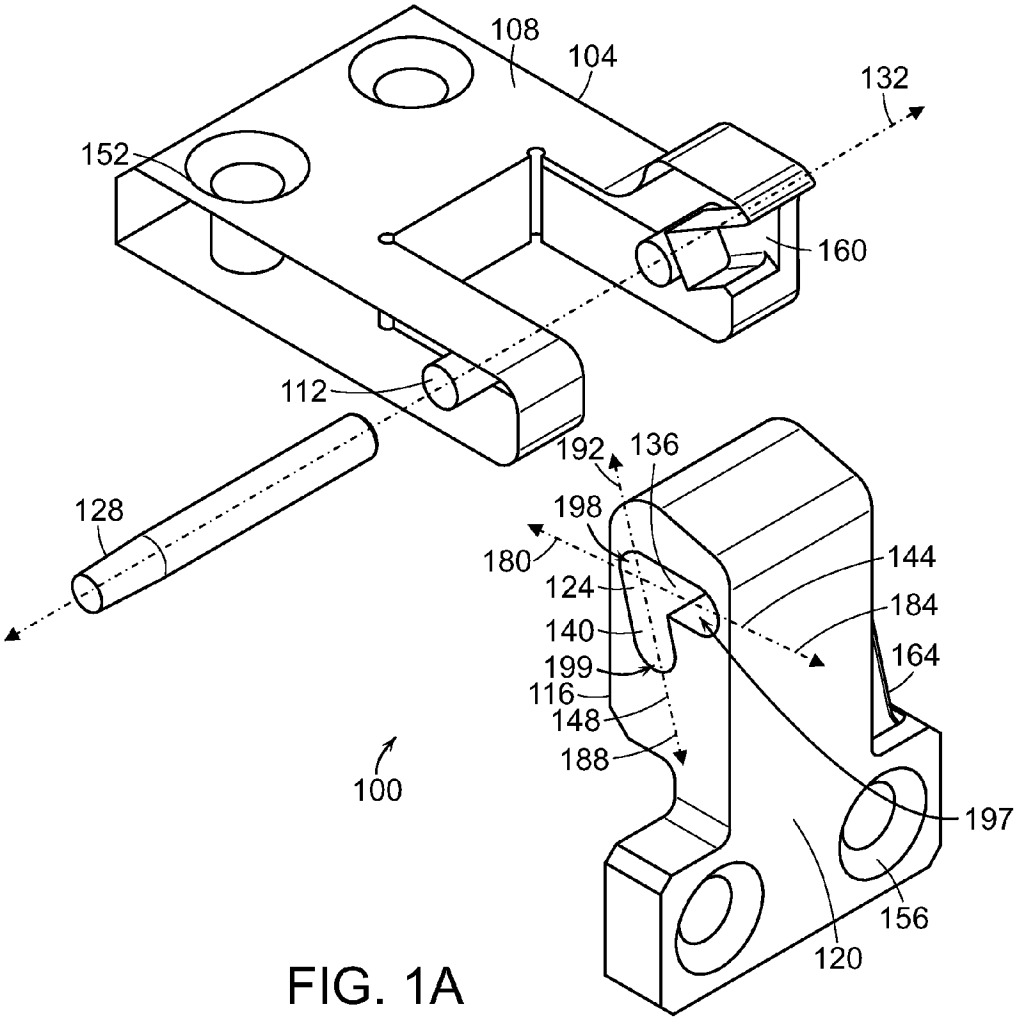
FIG. 1A is an exploded, isometric view of a locking hinge, according to an illustrative embodiment.
Figure 1D:
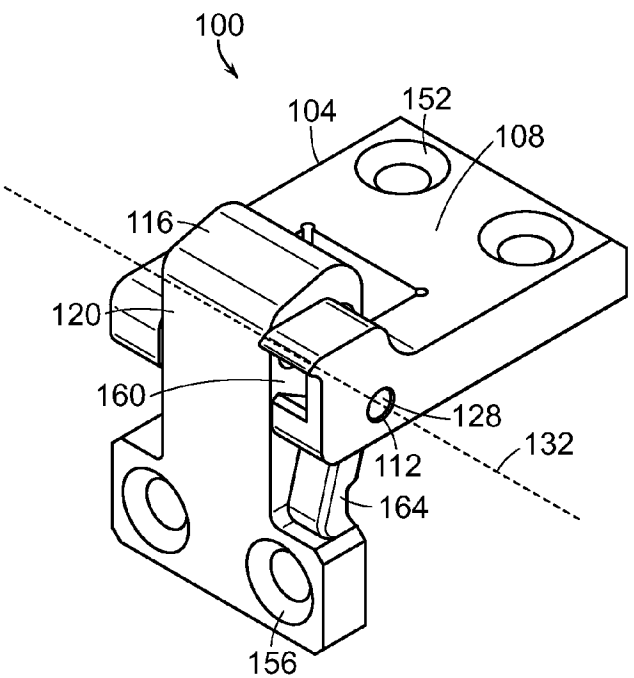
FIG. 1D is an assembled view of the locking hinge of FIG. 1C.
Figure 1C:
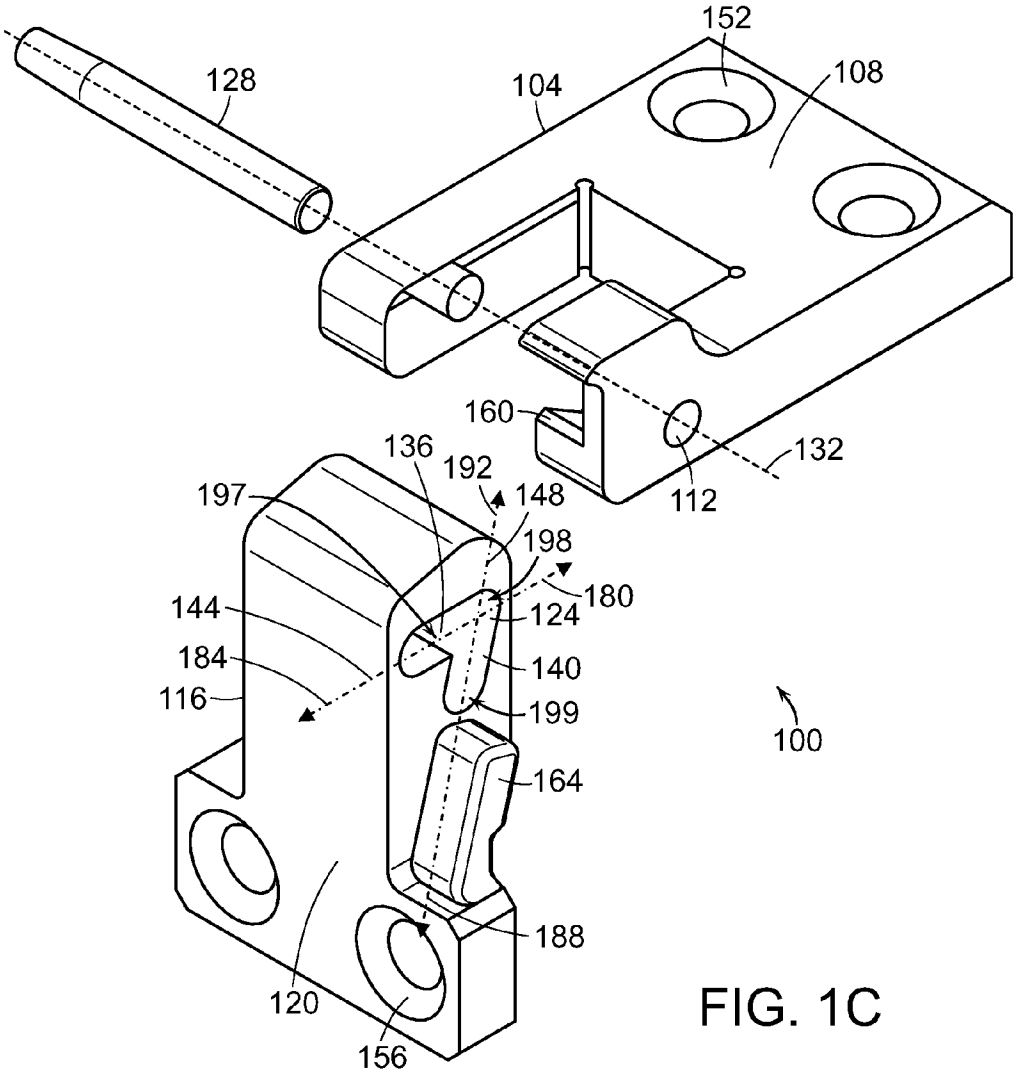
FIG. 1C is an exploded, isometric view of the locking hinge of FIG. 1A from a second perspective.

FIGS. 1A and 1C are exploded, isometric views of a locking hinge 100, according to an illustrative embodiment. FIG. 1A depicts the locking hinge 100 from a first perspective view and FIG. 1C depicts the locking hinge from a second perspective view. FIG. 1B is an assembled view of the locking hinge 100 view illustrated in FIG. 1A. FIG. 1D is an assembled view of the locking hinge 100 view illustrated in FIG. 1C.

The locking hinge 100 includes a first hinge element 104 that has a body 108 defining a first hole 112. The locking hinge 100 also includes a second hinge element 116 that has a body 120 defining a second hole 124. The body 108 of the first hinge element 104 also defines a slot 160 capable of receiving a slot key 164 associated with the second hinge element 116. In operation, the slot key 164 fits within the slot 160 to limit, at least, some movement of the second hinge element 116 relative to the first hinge element 104.

The combination of the slot 160 and slot key 164 is a locking mechanism. Some embodiments include alternative locking mechanisms. In some embodiments, the locking mechanism includes a machined slot in the body 108 of the first hinge element 104 and a dowel pin or threaded screw coupled to the second hinge element 116. In operation, the dowel pin or threaded screw engages the machined slot to limit movement of the second hinge element 116 relative to the first hinge element 104.

In this embodiment, the second hole 124 of the second hinge element 116 is a slot having a first channel 136 and a second channel 140. The first channel 136 of the slot intersects the second channel 140 of the slot. The first channel 136 is aligned with a first axis 144 defining a first direction 180 and a second (opposite) direction 184. The second channel 140 is aligned with a second axis 148 defining a first direction 188 and a second (opposite) direction 192.

The locking hinge 100 also includes a dowel 128 assembled through the first hole 112 in the first hinge element 104 and the second hole 124 in the second hinge element 116 that defines a hinge joint axis 132. The assembled locking hinge 100 permits translation of the second hinge element 116 relative to the first hinge element 104 along the first axis 144 and translation of the second hinge element 116 relative to the first hinge element 104 along the second axis 148. The assembled locking hinge 100 also permits rotation of the second hinge element 116 relative to the first hinge element 104 about the hinge joint axis 128. The second hinge element 116 is capable of rotation relative to the first hinge element 104 in a first direction 190 (illustrated by the arrows) about the hinge joint axis 132. The second hinge element 116 is also capable of rotation relative to the first hinge element 104 in a second (opposite) direction 194 (illustrated by the arrows) about the hinge joint axis 132.

The first hinge element 104 and the second hinge element 116 also each include one or more mounting holes 152 and 156, respectively, which permit a user to integrate the locking hinge 100 for use with a suitable structure; non-limiting examples of structures are described elsewhere herein. The hinge elements 104 and 116 can include, alternatively or in addition, mounting features other than mounting holes for coupling the hinge elements to the structure. For example, in some embodiments, the hinge elements 104 and 116 include threaded rods, instead of mounting holes, to couple the hinge elements 104 and 106 to the structure. In some embodiments, the hinge elements 104 and 116 are glued, welded, or in some manner adhered/coupled to the structure.

Embodiments of the locking hinge can be fabricated or produced from a variety of materials including, but not limited to, metals (e.g., steel, titanium, nickel, copper) alloys (e.g., stainless steel, aluminum alloys), plastics, polymers, or composite materials.

In some embodiments, features of a component of the locking hinge may be located on a different component of the locking hinge. By way of example, in one embodiment, the slot 160 is instead located on the second hinge element 116 and the slot key 164 is located on the first hinge element 104.

Figure 2:
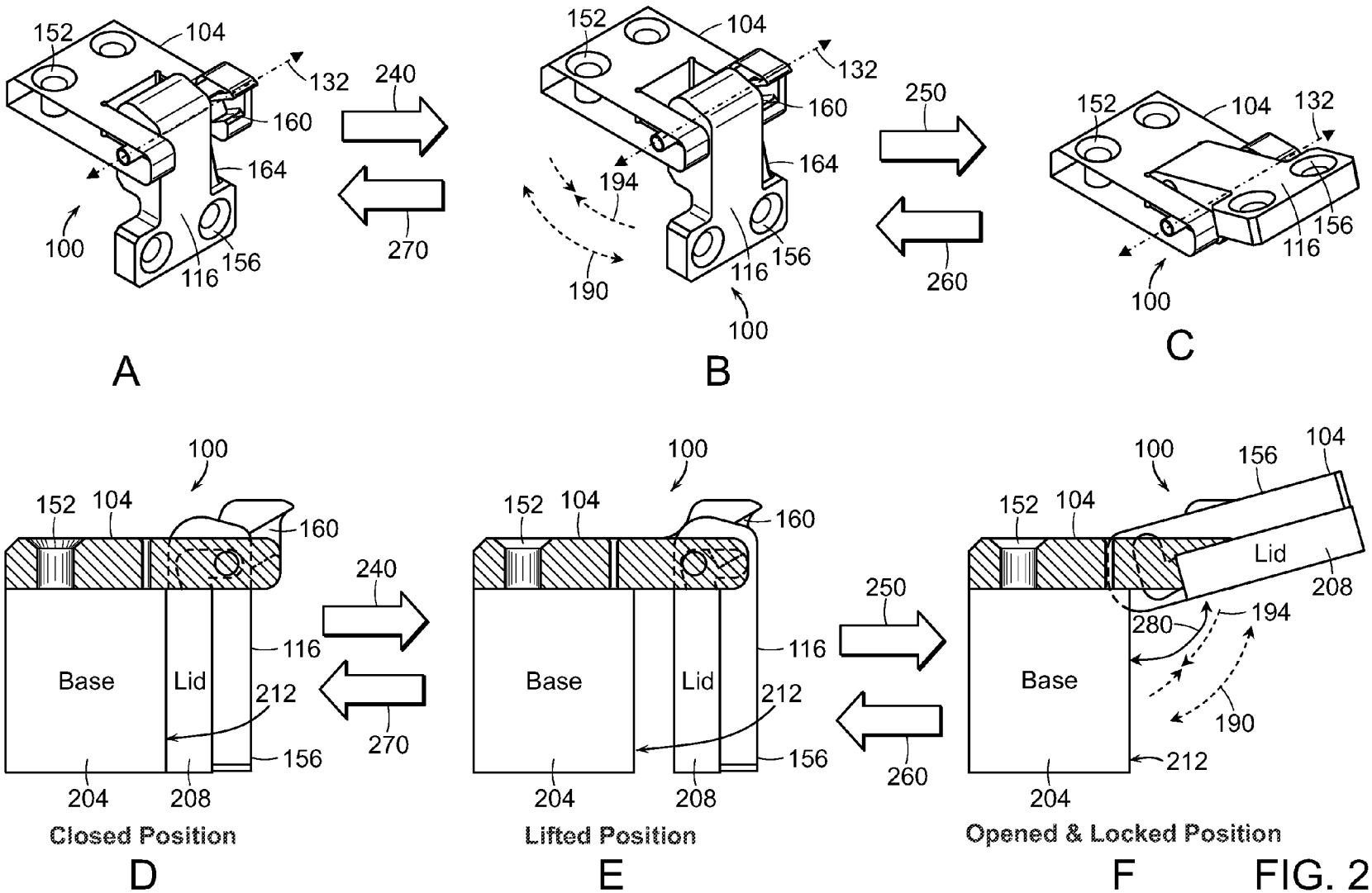
FIG. 2 is a schematic illustration of a method for operating a locking hinge, according to an illustrative embodiment.

FIG. 2 is a schematic illustration of a method for operating a locking hinge (e.g., the locking hinge 100 of FIGS. 1A-1D), according to an illustrative embodiment. View "A" of FIG. 2 depicts the locking hinge 100 from the same perspective and in the same configuration as depicted in FIG. 1B. View "D" of FIG. 2 depicts the locking hinge 100 from a side of the locking hinge in a closed position. The locking hinge 100 is coupled to a box structure (combination of base 204 and lid 208) with the mounting holes 152 and 156. In the closed position, the lid 208 is in contact with a surface 212 of the base 204. The first hinge element 104 is coupled to the base 204 with a bolt (not shown) passing through the mounting hole 152. The second hinge element 116 is coupled to the cover 208 with a bolt (not shown) passing through the mounting hole 156. The second hinge element 116 is initially located (in Views "A" and "D") at a first end 197 of the first channel 136 (with reference to FIG. 1A).

The method of using the locking hinge 100 includes displacing (step 240) the second hinge element 116 relative to the first hinge element 104 along the first direction 180 of the first axis 144 to location 198 (with reference to FIG. 1A). Views "B" and "E" depict the locking hinge 100 in a position after the second hinge element 116 has been displaced relative to the first hinge element 104 along the first direction 180 (thereby opening the box structure).

In some embodiments, the box structure includes electronic and/or mechanical components within the base 204 that are initially coupled to electronic and/or mechanical components coupled to the lid 208. The action of displacing the second hinge element 116 relative to the first hinge element 104 along the first direction 180 of the first axis 144 decouples or disconnects the electronic and/or mechanical components associated with the lid 208 from the electronic and/or mechanical components associated with the base 204. When the second hinge element 116 is displaced in a linear, orthogonal direction relative to the first hinge element 104, the components are safely decoupled or disconnected. Prior art hinges that allow only for rotational motion would not safely disengage because, for example, one portion of the hinge would not move in a linear direction relative to another portion of the hinge to permit for the linear motion required to decouple or disconnect.

The method also includes rotating the second hinge element 116 relative to the first hinge element 104 in a first direction 190 about the hinge joint axis 132. The method also includes displacing the second hinge element 116 relative to the first hinge element 104 along a first direction 188 of the second axis 148 (with reference to FIG. 1A). Views "C" and "F" depict the locking hinge 100 in a position after the second hinge element 116 has been 1) rotated relative to the first hinge element 104 in the first direction 190 about the hinge joint axis 132 and 2) displaced relative to the first hinge element 104 along the first direction 188 of the second axis 148 (collectively step 250, resulting in the opened and locked position).

In this embodiment, the method (step 250) includes displacing the second hinge element 116 relative to the first hinge element 104 along a first direction 188 of the second axis 148 to location 199 (with reference to FIG. 1A) until the slot key 164 of the second hinge element 116 engages the slot 160 of the first hinge element 104. The second hinge element 116 is locked when the second hinge element 116 engages the slot 160 of the first hinge element 104. In this embodiment, the second hinge element 116 is locked when it cannot be rotated about the hinge joint axis 132. The second hinge element 116 is located at an angle 280 relative to the surface 212 of the base 204 in the opened and locked position. In this embodiment, the angle 280 is 105 degrees; however, the locking hinge 100 may be locked at different angles in alternative embodiments as described later herein. Because the angle 280 is greater than about 90 degrees in this embodiment, an operator may readily access items located in the base 204 behind the surface 212 of the base 204 because the lid 208 does not obstruct the surface 212 of the base 204.

In this embodiment, the method also includes closing the lid relative to the base. The second hinge element 116 is unlocked by displacing the second hinge element 116 along the second (opposite) direction 192 of the second axis 148 to disengage the slot key 164 from the slot 160. The method also includes rotating the second hinge element 116 relative to the first hinge element 104 in a second (opposite) direction 194 about the hinge joint axis 132. Views "B" and "E" depict the locking hinge 100 in a position after the second hinge element 116 has been 1) displaced relative to the first hinge element 104 along the second direction 192 of the second axis 148 and 2) rotated relative to the first hinge element 104 in the second direction 194 about the hinge joint axis 132 (collectively step 260, resulting in the lifted position).

The method of using the locking hinge 100 also includes displacing (step 270, resulting in the closed position) the second hinge element 116 relative to the first hinge element 104 along the second direction 184 of the first axis 144 (with reference to FIG. 1A). Views "A" and "D" depict the locking hinge 100 in a position after the second hinge element 116 has been displaced relative to the first hinge element 104 along the second direction 184 of the first axis 144.

Embodiments of the locking hinges described herein may be used with a variety of structures (e.g., box structure) in which relative movement (i.e., translation and/or rotation) is desired. By way of example, one embodiment includes an electronics box structure that includes a module mounting frame (e.g., for carrying a circuit board assembly) and a backplane. The first hinge element 104 is coupled to the module mounting frame and the second hinge element is coupled to the backplane. In this manner, the locking hinge can be applied to make fixed backplanes or motherboards adjustable/pivotable for easy servicing access of electronics boxes. Motherboards require lateral movement (e.g., lateral displacement described with respect to step 240 of FIG. 2) to disengage the alignment pins and connector contacts that currently do not exist in available hinges.

Figure 3:
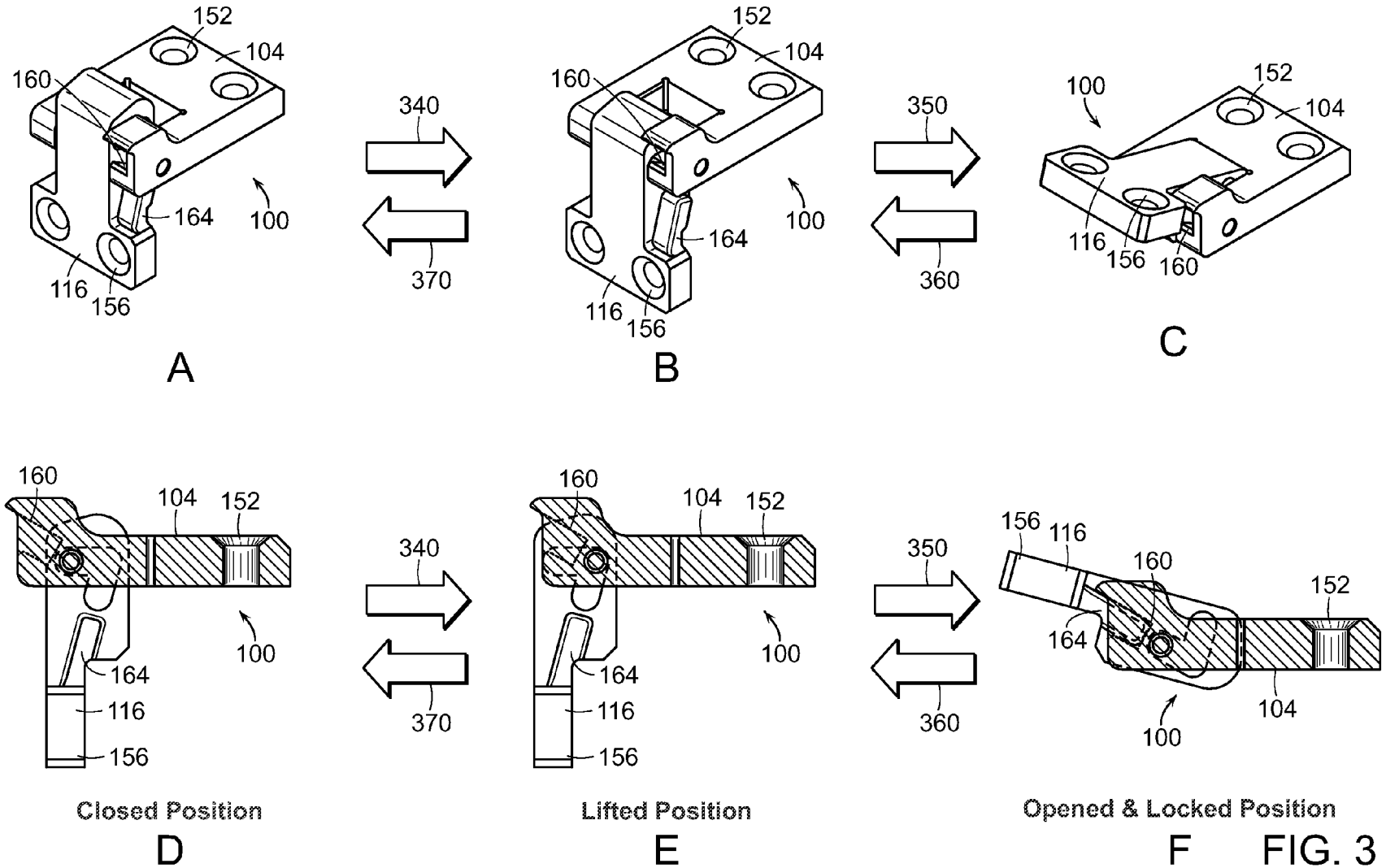
FIG. 3 is a schematic illustration of a method for operating a locking hinge, according to an illustrative embodiment.

FIG. 3 is a schematic illustration of a method for operating a locking hinge (e.g., the locking hinge 100 of FIGS. 1A-1D), according to an illustrative embodiment. View "A" of FIG. 3 depicts the locking hinge 100 from the same perspective and in the same configuration as depicted in FIG. 1D. View "D" of FIG. 3 depicts the locking hinge 100 from a side of the locking hinge in a closed position. The second hinge element 116 is initially located (in Views "A" and "D") at a first end 197 of the first channel 136 (with reference to FIG. 1A).

The method of using the locking hinge 100 includes displacing (step 340) the second hinge element 116 relative to the first hinge element 104 along the first direction 180 of the first axis 144 to location 198 (with reference to FIG. 1A). Views "B" and "E" depict the locking hinge 100 in a position after the second hinge element 116 has been displaced relative to the first hinge element 104 along the first direction 180.

The method also includes rotating the second hinge element 116 relative to the first hinge element 104 in a first direction 190 about the hinge joint axis 132. The method also includes displacing the second hinge element 116 relative to the first hinge element 104 along a first direction 188 of the second axis 148 (with reference to FIG. 1A). Views "C" and "F" depict the locking hinge 100 in a position after the second hinge element 116 has been 1) rotated relative to the first hinge element 104 in the first direction 190 about the hinge joint axis 132 and 2) displaced relative to the first hinge element 104 along the first direction 188 of the second axis 148 (collectively step 350, resulting in the opened and locked position).

In this embodiment, the method (step 350) includes displacing the second hinge element 116 relative to the first hinge element 104 along a first direction 188 of the second axis 148 to the location 199 (with reference to FIG. 1A) until the slot key 164 of the second hinge element 116 engages the slot 160 of the first hinge element 104. The second hinge element 116 is locked when the second hinge element 116 engages the slot 160 of the first hinge element 104. In this embodiment, the second hinge element 116 is locked when it cannot be rotated about the hinge joint axis 132.

In this embodiment, the method also includes manipulating the locking hinge until it is again in the unlocked position. The second hinge element 116 is unlocked by displacing the second hinge element 116 along the second (opposite) direction 192 of the second axis 148 to disengage the slot key 164 from the slot 160. The method also includes rotating the second hinge element 116 relative to the first hinge element 104 in a second (opposite) direction 194 about the hinge joint axis 132. Views "B" and "E" depict the locking hinge 100 in a position after the second hinge element 116 has been 1) displaced relative to the first hinge element 104 along the second direction 188 of the second axis 148 and 2) rotated relative to the first hinge element 104 in the second direction 194 about the hinge joint axis 132 (collectively step 360, resulting in the lifted position).

The method of using the locking hinge 100 also includes displacing (step 370, resulting in the closed position) the second hinge element 116 relative to the first hinge element 104 along the second direction 184 of the first axis 144 (with reference to FIG. 1A). Views "A" and "D" depict the locking hinge 100 in a position after the second hinge element 116 has been displaced relative to the first hinge element 104 along the second direction 184 of the first axis 144.

Figure 4:
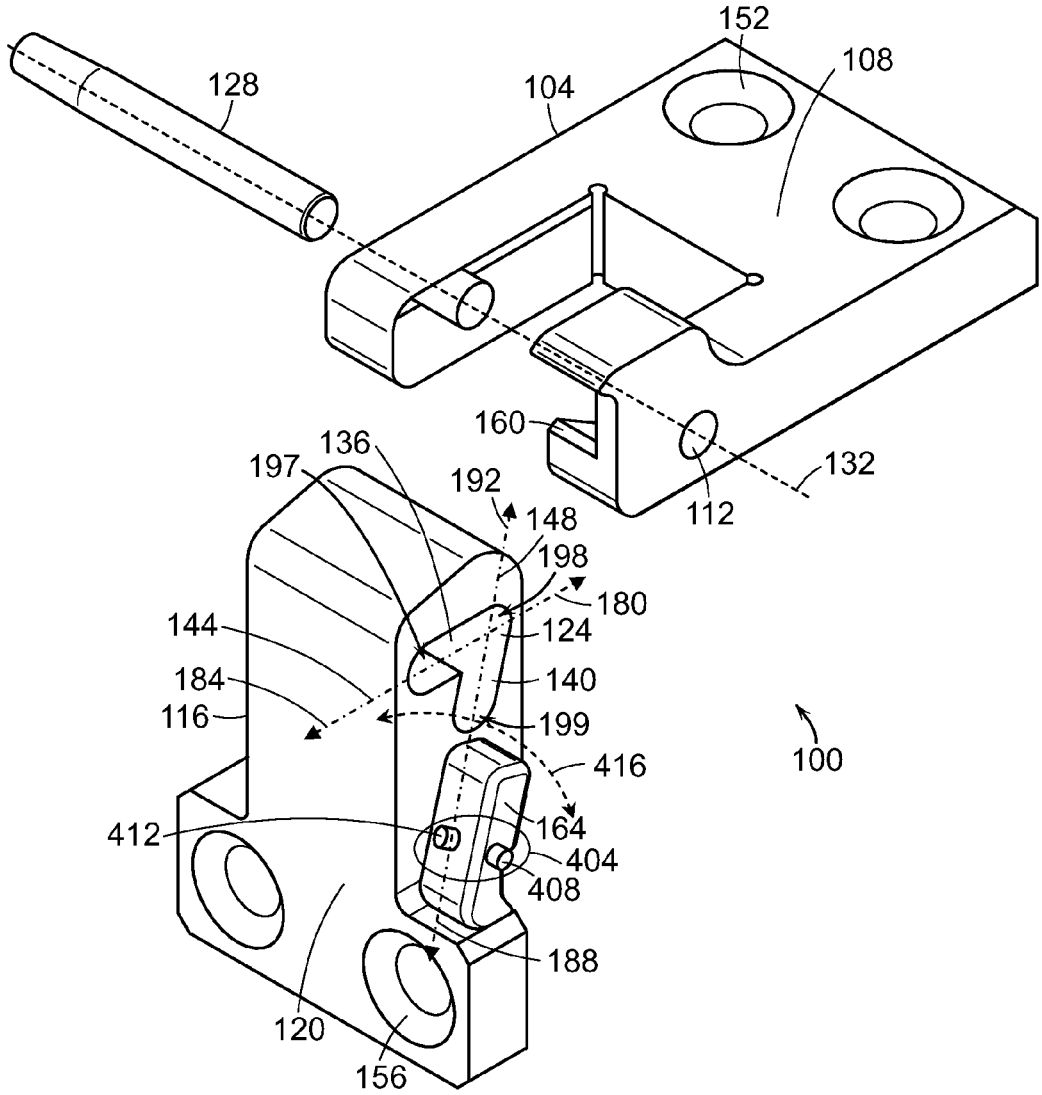
FIG. 4 is an exploded, isometric view of a locking hinge, according to an illustrative embodiment.

FIG. 4 is an exploded, isometric view of a locking hinge 100, according to an illustrative embodiment. The locking hinge 100 is the same in structure as the locking hinge 100 of FIGS. 1A-1D with the exception that the slot key 164 of the second hinge element 116 includes an adjustment mechanism 404. The adjustment mechanism 404 permits an operator to adjust orientation of the slot key 164 on the second hinge element 116. In this embodiment, the adjustment mechanism 404 includes a dowel 408 and a set screw 412. The dowel 408 passes through the slot key 164. The slot key 164 is capable of rotating about an axis defined by the dowel 408 transcribing an arc 416 at a variety of angles. The set screw 412 is operative to lock the slot key 164 to the dowel 408 to fix the angular position of the slot key 164 relative to the body 120 of the second hinge element 116.

By being able to vary the angular position of the slot key 164 relative to the body 120 of the second hinge element 116, an operator may vary the angular position of the second hinge element 116 relative to the first hinge element 104 (or, by extension, vary the angular position of a first structure coupled to the second hinge element 116 relative to a second structure coupled to the first hinge element 104). By way of example, and reference to FIG. 4 and FIG. 2 View "F", an operator may vary the angular position of the slot key 164 along the arc 416 (with reference to FIG. 4) and thereby vary the value of the angle 280 in the opened and locked position (with reference to FIG. 2 View "F"). By varying the value of the angle 280 in the opened and locked position, an operator may alter the angle defined between the first hinge element 104 and the second hinge element 116 about the hinge joint axis 132. In this manner, an operator may adjust the adjustment mechanism 404 associated with the slot key 164 to alter angular position between the first hinge element 104 and the second hinge element 116 to a desired open position.

Comprise, include, and/or plural forms of each are open ended and include the listed parts and can include additional parts that are not listed. And/or is open ended and includes one or more of the listed parts and combinations of the listed parts.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

The invention claimed is:

1. A locking hinge, comprising a first hinge element including a body defining a first hole;

a second hinge element including a body defining a second hole;

wherein the second hole of the second hinge element is a slot having a first channel that intersects a second channel, wherein the first channel is aligned with a first axis and the second channel is aligned with a second axis;

wherein the body of the second hinge element comprises a slot key and the body of first hinge element defines a slot capable of receiving the slot key;

wherein the slot key fits within the slot to limit movement of the second hinge element relative to the first hinge element;

wherein the slot key includes an adjustment mechanism for adjusting orientation of the slot key on the second hinge element; and a dowel assembled through the first hole in the first hinge element and the second hole in the second hinge element defining a hinge joint axis permitting translation of the second hinge element relative to the first hinge element along the first channel along the first axis and along the second channel along the second axis, and rotation of the second hinge element relative to the first hinge element about the hinge joint axis.

2. The locking hinge of claim 1, wherein adjusting the orientation of the slot key on the second hinge element alters an angle between the first hinge element and the second hinge element about the hinge joint axis.

3. The locking hinge of claim 1, comprising mounting features in the body of the first hinge element and the body of the second hinge element to couple the first hinge element and second hinge element to a structure.

4. The locking hinge of claim 3, wherein the mounting features are mounting holes.

5. The locking hinge of claim 1, comprising a base coupled to the first hinge element and a lid coupled to the second hinge element.

6. The locking hinge of claim 1, comprising a locking mechanism to limit movement of the second hinge element relative to the first hinge element.

7. A method for operating a locking hinge that comprises a first hinge element including a body defining a first hole, a second hinge element including a body defining a second hole, wherein the second hole of the second hinge element is a slot having a first channel that intersects a second channel, wherein the first channel is aligned with a first axis and the second channel is aligned with a second axis, and a dowel assembled through the first hole in the first hinge element and the second hole in the second hinge element defining a hinge joint axis permitting translation of the second hinge element relative to the first hinge element along the first channel along the first axis and along the second channel along the second axis, and rotation of the second hinge element relative to the first hinge element about the hinge joint axis, the method comprising:

displacing the second hinge element relative to the first hinge element along a first direction of the first axis;

rotating the second hinge element relative to the first hinge element in a first direction about the hinge joint axis;

displacing the second hinge element relative to the first hinge element along a first direction of the second axis until a slot key associated with the body of the second hinge element engages a slot associated with the body of the first hinge element; and adjusting an adjustment mechanism associated with the slot key to alter an angle between the first hinge element and the second hinge element about the hinge joint axis.

8. The method of claim 7, wherein the second hinge element is locked when the slot key engages the slot.

9. The method of claim 7, comprising displacing the second hinge element relative to the first hinge element along a second direction of the second axis until the slot key associated with the body of the second hinge element disengages the slot associated with the body of the first hinge element.

10. The method of claim 9, comprising rotating the second hinge element relative to the first hinge element in a second direction about the hinge joint axis.

11. The method of claim 10, comprising displacing the second hinge element relative to the first hinge element along a second direction of the first axis.

12. A method for operating a locking hinge of a structure that includes a base and a lid, wherein a first hinge element of the locking hinge is coupled to the base and a second hinge element of the locking hinge is coupled to the lid, and the first hinge element includes a body defining a first hole, the second hinge element includes a body defining a second hole, wherein the second hole of the second hinge element is a slot having a first channel that intersects a second channel, wherein the first channel is aligned with a first axis and the second channel is aligned with a second axis, and the locking hinge includes a dowel assembled through the first hole in the first hinge element and the second hole in the second hinge element defining a hinge joint axis permitting translation of the second hinge element relative to the first hinge element along the first channel along the first axis and along the second channel along the second axis, and rotation of the second hinge element relative to the first hinge element about the hinge joint axis, the method comprising:

displacing the second hinge element relative to the first hinge element along a first direction of the first axis to open the structure by displacing the lid from a surface of the base;

rotating the second hinge element relative to the first hinge element in a first direction about the hinge joint axis;

displacing the second hinge element relative to the first hinge element along a first direction of the second axis until a slot key associated with the body of the second hinge element engages a slot associated with the body of the first hinge element; and adjusting an adjustment mechanism associated with the slot key to alter angular position between the first hinge element and the second hinge element to a desired open position.

13. The method of claim 12, comprising displacing the second hinge element relative to the first hinge element along a second direction of the second axis until the slot key associated with the body of the second hinge element disengages the slot associated with the body of the first hinge element.

14. The method of claim 13, comprising rotating the second hinge element relative to the first hinge element in a second direction about the hinge joint axis.

15. The method of claim 14, comprising displacing the second hinge element relative to the first hinge element along a second direction of the first axis to close the structure by causing the lid to contact the surface of the base.

16. A method for operating a locking hinge of an electronics box structure that includes a module mounting frame and a backplane, wherein a first hinge element of the locking hinge is coupled to the module mounting frame structure and a second hinge element of the locking hinge is coupled to a backplane, and the first hinge element includes a body defining a first hole, the second hinge element includes a body defining a second hole, and the locking hinge includes a dowel assembled through the first hole in the first hinge element and the second hole in the second hinge element defining a hinge joint axis permitting translation of the second hinge element relative to the first hinge element along a first axis and a second axis, and rotation of the second hinge element relative to the first hinge element, the method comprising:

displacing the second hinge element relative to the first hinge element along a first direction of the first axis to disengage the backplane by displacing the backplane from a surface of the module mounting frame;

rotating the second hinge element relative to the first hinge element in a first direction about the hinge joint axis;

adjusting an adjustment mechanism associated with a slot key associated with the body of the second hinge element to alter angular position between the first hinge element and the second hinge element to a desired open position when the slot key associated with the body of the second hinge element engages a slot associated with the body of the first hinge element.

17. The method of claim 16, comprising displacing the second hinge element relative to the first hinge element along a first direction of the second axis until the slot key associated with the body of the second hinge element engages the slot associated with the body of the first hinge element.

18. The method of claim 17, comprising displacing the second hinge element relative to the first hinge element along a second direction of the second axis until the slot key associated with the body of the second hinge element disengages the slot associated with the body of the first hinge element.

19. The method of claim 18, comprising rotating the second hinge element relative to the first hinge element in a second direction about the hinge joint axis.

20. The method of claim 19, comprising displacing the second hinge element relative to the first hinge element along a second direction of the first axis to close the electronics box structure by causing the backplane to contact the surface of the module mounting frame.

* * * * *